United States Patent [19]

Bader

[11] Patent Number: 4,893,672

[45] Date of Patent: Jan. 16, 1990

[54] COUNTER-FLOW HEAT EXCHANGER WITH HELICAL TUBE BUNDLE

[76] Inventor: Emil E. Bader, Zürcherstrasse 1, CH-8142, Uitikon Waldegg, Switzerland

[21] Appl. No.: 193,299

[22] PCT Filed: Aug. 21, 1987

[86] PCT No.: PCT/CH87/00106

§ 371 Date: Apr. 21, 1988

§ 102(e) Date: Apr. 21, 1988

[87] PCT Pub. No.: WO88/01363

PCT Pub. Date: Feb. 25, 1988

[30] Foreign Application Priority Data

Aug. 21, 1986 [CH] Switzerland ..... 3348/86

[51] Int. Cl.[4] ..... F28D 7/02

[52] U.S. Cl. ..... 165/163; 165/173; 165/95

[58] Field of Search ..... 165/95, 163, 173, 175

[56] References Cited

U.S. PATENT DOCUMENTS

| | | | |
|---|---|---|---|
| 1,840,940 | 1/1932 | Ecabert | 165/163 X |
| 2,519,084 | 8/1950 | Tull | 165/163 X |
| 2,566,976 | 9/1951 | Bernstrom | 165/163 X |
| 3,130,780 | 4/1964 | Winship | 165/163 |
| 4,114,686 | 9/1978 | Mueller et al. | 165/110 |
| 4,346,759 | 8/1982 | Cohen et al. | 165/163 |
| 4,596,286 | 6/1986 | Stetler | 165/92 |

FOREIGN PATENT DOCUMENTS

| | | | |
|---|---|---|---|
| 644419 | 7/1962 | Canada | 165/163 |
| 1035120 | 8/1953 | France | 165/176 |
| 2082312A | 3/1982 | United Kingdom | 165/173 |

*Primary Examiner*—Martin P. Schwadron
*Assistant Examiner*—Allen J. Flanigan
*Attorney, Agent, or Firm*—Frost & Jacobs

[57] ABSTRACT

A counter-flow heat exchanger includes helical tube bundles for passage of a primary fluid, the helical tube bundles forming a closed helical flow channel between a core tube and a tubular shell around a common longitudinal axis, with a secondary fluid passing through the closed helical flow channel in countercurrent flow, each tube bundle comprising a plurality of linearly arrayed contiguous helical tubes, the helical tubes each being connected at both ends to a connecting compartment composed of a perforated connecting plate and a cover. The helical tube bundles rest freely on helically arranged brackets which are secured on the core tube and are positioned in different radial planes and extend outwardly to the tubular shell, with straps connecting each bracket in a radial plane. The helical tube bundles may be exposed for cleaning by removing them from the tubular shell together with their connecting compartments, cover plate, core tube, primary inlet and primary outlet.

8 Claims, 2 Drawing Sheets

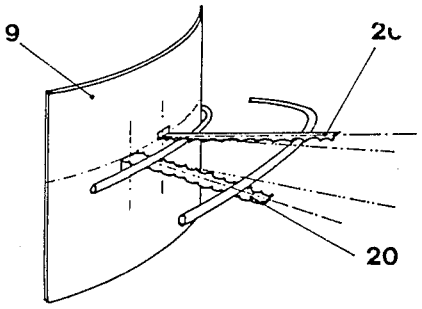
Fig. 4
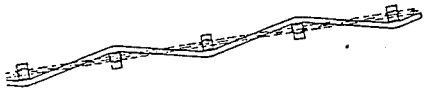
Fig. 5
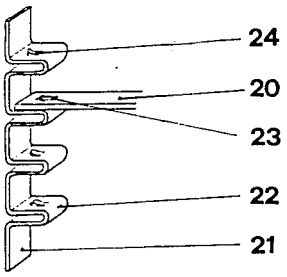
Fig. 7
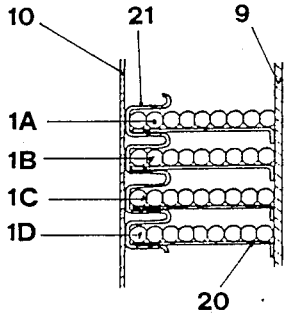
Fig. 6
Fig. 8
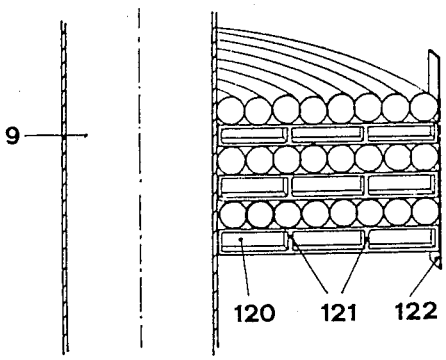

COUNTER-FLOW HEAT EXCHANGER WITH HELICAL TUBE BUNDLE

BACKGROUND OF THE INVENTION

The invention relates to a counter-flow heat exchanger with at least one helical tube bundle forming a closed helical flow channel between a core tube and a tubular shell around a common longitudinal axis, a plurality of helical tubes being coiled in a corresponding helical plane with constant pitch around said common axis, arrayed without interruption and combined in the helical tube bundle, while a primary fluid and a secondary fluid respectively traverse the helical tubes and the helical flow channel in countercurrent flow.

It is known that counter-flow heat exchangers provide a higher efficiency than cross-flow type heat exchangers and are particularly necessary when the temperature differences between the heat exchange media are relatively small.

Conventional heat exchangers with a plurality of tubes have drawbacks with regard to the connection and cleaning of numerous inaccessible tubes with small spacing. It is further difficult in most cases to maintain a plurality of relatively long and flexible tubes with the required spacing. Such heat exchangers are in general unsuitable for operation as a counter-flow heat exchanger with little maintenance so that they are unsuitable for various applications.

Plate heat exchangers are on the other hand suitable as counter-flow heat exchangers, but have the disadvantage that they must be dismantled each time to enable cleaning of the plates, while sealing after each dismantling may be problematic.

In a counter-flow heat exchanger of the initially mentioned type, the helical tubes must be arrayed without interruption in order to form a closed helical flow channel and to thereby ensure operation in true contercurrent flow with high efficiency.

However, the assembly of tube bundles with contiguous helical tubes and their connection become particularly problematic as the number of tubes increases and were hitherto at best possible with a very small number of helical tubes.

The related problems underlying the present invention may be explained by, among other things, the fact that coiled tubes can not be formed so exactly as to be arrayed to closed helical surfaces, without at the same time causing stresses. However, the effect of stresses on round tubes in contact along a spiral line is such that with slight disturbances one helical tube may slip off the other. The convex tube walls pressing against each other are consequently in unstable equilibrium, so that a small deflecting force may bring unsecured tubes out of their correct position.

On the other hand, in another known design, helical tubes are kept separated from each other with a given spacing by various support structures. In this case a primary fluid flows through the helical tubes, while a secondary fluid flows essentially across and between these helical tubes. This arrangement thereby essentially corresponds to a cross-flow type heat exchanger with a considerably lower efficiency than a conter-flow heat exchanger.

The following patent publications may be cited to illustrate the invention with regard to the state of the art relating to heat exchangers of the initially defined type: GB-A- 791843; FR-A 2482717; and FR-A- 2214093.

These known heat exchangers have tube bundles with only three to four helical tubes and with a limited exchange surface and a scope of application which is limited accordingly.

As already mentioned, the manufacture of tube bundles of this type becomes particularly problematic when the number of tubes is increased inasmuch as the connection of the contiguous tubes becomes particularly difficult due to the inaccessibility of the tube ends and therefore is not possible with conventional connecting means.

It is further particularly difficult to bend rigid tubes into exactly contiguous coils and to connect them by conventional connecting means.

On the other hand, relatively flexible tubes can be much more easily coiled, but must be secured in their desired position in the tube bundle, in order to obtain stable tube bundles.

The production of compact counter-flow heat exchangers with as large a number of helical tubes as possible would be particularly advantageous in order to obtain a maximum exchange surface with optimum efficiency.

SUMMARY OF THE INVENTION

The invention has the object of providing a heat exchanger of the initially defined type, which has any number of helical tubes and tube bundles, may be simply and inexpensively produced from quite different types of materials, while largely avoiding the mentioned disadvantages.

This object is met according to the invention by the helical tubes being equipped at each end of the tube bundle with a connecting compartment which is composed of a perforated connecting plate with a removable cover and is arranged between the core tube and the tubular shell in such a manner that the ends of the helical tubes are alternately mounted, without substantially deviating from the corresponding helical plane, in corresponding holes in staggered arrangement in the connecting plate and are solidly connected therewith. The cover is here solidly mounted on this connecting plate and is arranged in such a manner that it connects the connecting compartment with a primary inlet or a primary outlet.

The connecting plate of the connecting compartment according to the invention is preferably provided with two rows of holes in staggered arrangement which extend parallel to the corresponding helical plane at a short distance on either side thereof. The ends of the helical tubes are here alternately slightly bent aside on both sides of said helical plane, then extend parallel to said helical plane and are alternately connected at the corresponding holes of both said rows.

According to a preferred embodiment of the invention, the heat exchanger is characterized in that flexible helical tubes rest freely against a, plurality of brackets which are solidly connected with the core tube and are distributed in the corresponding helical plane around the core tube in such a manner that the helical tubes are supported against each other in an unmovable position.

The flexible helical tubes may be advantageously alternately bent and supported by the brackets in opposite axial directions.

The helical tubes and the connecting compartments according to the invention may be advantageously made of any suitable plastics materials, for example those of the type designated by the trademark "Teflon" or "Tefzel" of Dupont. In this case the ends of the helical tubes may be tightly connected in a simple manner in the holes of the connecting plate by fusion bonding. All parts of the heat exchanger may preferably consist of the same plastics materials, or at least be covered therewith, in order to obtain the highest possible resistance of the entire heat exchanger against chemical attack and to thereby achieve maximum lifetime.

The brackets according to the invention are advantageously provided with a toothed arrangement for mounting the helical tubes and be profiled so as to provide stiffening.

Said brackets are advantageously inclined with respect to the common longitudinal axis, preferably alternately in opposite axial directions.

The brackets which are axially and peripherally staggered in the corresponding helical plane, which are fixed on one side to the core tube and on which all helical tubes of a tube bundle rest freely and are uniformly supported, enable the helical configuration of the whole tube bundle to be preserved.

The brackets according to the invention fulfill various functions with respect to the assembly of the helical tube bundles on the core tube, which may be explained as follows.

When coiling flexible tubes of plastics material or pliant metal, the tubes are in each case stretched due to the tension required, in order that the successively formed tube coils come to lie closely against each other. This tension thereby presses the first or innermost tube coil close to the core tube and each further tube coil to the preceding one. This tension exerts a radial force on the tubes, which may be decomposed into two components, of which one is directed parallel and the other perpendicular to the longitudinal axis of the bracket. The component parallel to the bracket presses each tube coil which is being formed by bending towards the preceding coil, and the perpendicular component presses the tube coil against the bracket. Statically seen, each bracket acts as a cantilever support arm fixed on one side (on the core tube).

It is known that the maximum bending moment of a cantilever support arm fixed on one side, and supported freely at the other end, is several times smaller than in the case of a selfsupporting cantilever arm.

When the brackets according to the invention should have a relatively great length or reach, in order to support a correspondingly large number of coils, the outer ends of the brackets may be held by lateral straps, in such a manner that the brackets are supported by these straps and thereby stiffened, and that their overall height may be kept small accordingly.

According to an advantageous embodiment, the brackets according to the invention are distributed in different radial planes and interconnected at their free end by straps in each radial plane.

Such straps are thereby advantageously arranged in such a manner that they on one hand keep the spacing constant between the brackets overlying each other, so that the height or the cross-section of the helical channels is everywhere kept equal. On the other hand, the straps secure the outermost coils, while this may be important particularly when the helical tube bundle arrangement is displaced relatively to the tubular shell.

In order to improve the exchange of heat, the heat exchanger according to the invention may, particularly when metallic helical tubes are used, be mounted for rotation about its common longitudinal axis and coupled with driving means arranged so as to be able to impart an oscillating rotary movement to the heat exchanger.

The heat transfer in the counter-flow heat exchanger with helical tube bundles according to the invention is here increased due to the fact that the whole heat exchanger is rotated to and fro in continuous sequence about its longitudinal axis. It is known that heat transfer between a flowing fluid and a tube wall is greatest in the starting stretch while, depending on the flow conditions, it may be several times higher in the starting stretch than after a certain distance of flow. This phenomenon is here exploited by making the heat exchanger rotate to and fro about its longitudinal axis. The additional velocities of both liquids with respect to the tube wall, which are superimposed on the underlying currents, both inside and outside the tubes, thereby increase and decrease continually. When the additional relative velocities and the underlying current lie within the same order of magnitude, hydrodynamic starting conditions are thereby continually generated in beat with the oscillating rotary movement, which lead to an increase of the heat transfer on the inner and outer sides of the tube wall.

BRIEF DESCRIPTION OF THE DRAWINGS

Embodiments of the invention will be explained with reference to the drawings. These show in:

FIG. 4 a partial perspective view of brackets on a core tube.

FIG. 5 the developed projection of a helical tube supported according to FIG. 4.

FIG. 6 a partial longitudinal section of the embodiment of the heat exchanger according to FIG. 3, equipped with straps.

FIG. 7 a partial perspective view of a strap of the embodiment according to FIG. 6.

FIG. 8 a partial longitudinal section of a further embodiment of the heat exchanger according to the invention with a variant of the brackets and straps.

DETAILED DESCRIPTION OF THE INVENTION

Figure 1:
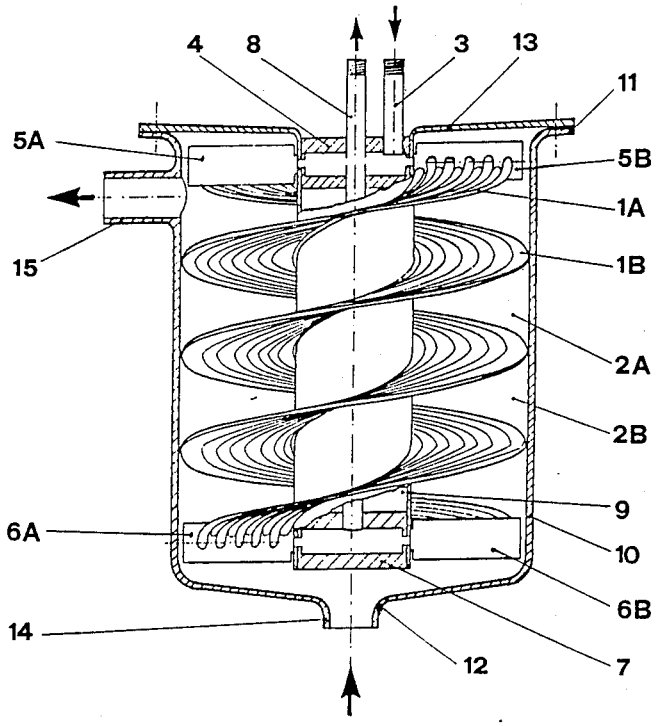
FIG. 1 a schematic longitudinal section of an embodiment of the heat exchanger according to the invention.

FIG. 1 shows an embodiment of the heat exchanger according to the invention with two helical tube bundles 1A, 1B for passage of a primary fluid in countercurrent flow with a secondary fluid passing through two corresponding helical flow channels 2A, 2B which are formed between the two helical tube bundles 1A and 1B extending in parallel.

As is indicated by arrows at the top in FIG. 1, the primary fluid is supplied from a primary inlet 3 via a central distributor 4 and two auxiliary distributors 5A, 5B to the upper end of the helical tube bundles 1A, 1B and is carried off from their lower end via two auxiliary collectors 6A, 6B, a central collector 7 and an upper primary outlet 8.

The auxiliary distributors 5A, 5B and the auxiliary collectors 6A, 6B consist of a two-part connecting compartment according to the invention and they will be subsequently designated as connecting compartments.

As may be seen from FIG. 1 the helical tube bundles 1A, 1B are arranged with their corresponding connecting compartments 5A, 5B and 6A, 6B in a closed annular chamber between a core tube 9 and a coaxial tubular shell 10 with a common longitudinal axis of the heat exchanger. As is shown schematically in FIG. 1, each tube bundle 1A, 1B consists of ten helical tubes which are coiled around the common longitudinal axis in a corresponding helical plane with constant pitch and closely arrayed between the core tube 9 and the tubular shell 10.

The heat exchanger housing consists of the tubular shell 10 with an outer flange 11, a bottom 12 and a cover plate 13, which is here made in one piece with the core tube 9 and is tightly connected with the outer flange 11.

This cover plate 13 forms together with the core tube 9, the tubular shell 10 and the bottom 12 the closed annular chamber which encloses the tube bundles 1A, 1B with their four connecting compartments 5A, 5B, 6A, 6B, while a secondary inlet 14 in the bottom 12 supplies a secondary fluid which flows upwards through the helical flow channels 2A, 2B and is discharged through a lateral secondary outlet 15 at the upper end of the tubular shell 10.

Figure 2:
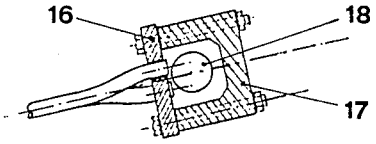
FIG. 2 a cross-section of a connecting compartment of the embodiment according to FIG. 1.

The assembly of the connecting compartments 5A, 5B and 6A, 6B is represented in cross-section in FIG. 2 and consists of a perforated connecting plate 16 and a removable cover 17 mounted thereon, with a tube section 18 which connects each connecting compartment with the corresponding central distributor 4 or central collector 7 arranged in the core tube 9.

The connecting plate 16 of the connecting compartments 5A, 5B, 6A, 6B according to the invention is arranged perpendicular to the corresponding helical plane and provided with holes which are staggered in two rows and extend parallel to the helical plane at a short distance therefrom to accomodate the ends of the helical tubes. The ends of the arrayed helical tubes are mounted in the corresponding staggered holes of the two rows in the connecting plate 16, tightly connected therewith and thereby connected in parallel to the corresponding connecting compartment 5A, 5B or 6A, 6B.

After connecting the helical tubes, the cover 17 is tightly connected with the connecting plate 16 in any suitable way, for example with screws and sealing means.

For coupling with the connecting compartments according to the invention as described, the ends of the helical tubes must only be slightly bent in order to be inserted alternately and fixed in two staggered rows in adjacent planes of corresponding holes parallel to the corresponding helical plane in the connecting plate 16.

This special arrangement of the connecting compartments provides decisive advantages with respect to known tube connections which require significant bending of the tube ends in order to join them tightly with a conventional connecting plate or the like.

This arrangement of the connecting compartments according to the invention thereby avoids in a very simple manner the important problems when connecting the tube bundles, the complicated bending for connecting numerous contiguous inaccessible tubes and any reduction of their strength by their deformation when bending with a too small bending radius being simply avoided.

After releasing the cover plate 13 from the outer flange 11, the entire assembly consisting of the cover plate 13 with the core tube 9 and the tube bundles 1A, 1B with the connecting compartments 5A, 5B and 6A, 6B, the primary inlet 3, the central distributor 4 and the central collector 7 with the primary outlet 8, may be drawn out as a whole from the tubular shell 10.

Thanks to this special arrangement of the helical tube bundles 1A, 1B with the connecting compartments 5A, 5B and 6A, 6B on the core tube 9 according to the invention, the tube bundles may thereby be exposed in a particularly simple manner and rapidly and effectively cleaned as occasion demands, for example with liquid jets or brushes which are brought in from the side.

This constitutes a particularly important advantage of the heat exchanger arrangement according to the invention inasmuch as effective cleaning of the helical tube bundles is indispensable for many applications, particularly when the secondary fluid forms on the outer surface of the helical tubes a deposit which more or less rapidly diminishes the heat transfer.

The embodiment of the heat exchanger according to the invention described above includes two helical tube bundles, while their number may be readily increased.

However, as opposed to known heat exchangers of the same type, the heat exchanger according to the invention allows both the number of arrayed contiguous helical tubes as well as the number of tube bundles to be increased without any particular difficulty by equipping the heat exchanger accordingly with the connecting compartments required in each case.

It is further possible, when the number of tube bundles increases, to arrange the connecting compartments according to the invention in several transverse planes, i.e. to stagger them with respect to the common longitudinal axis in such a manner that a freely selected number of tube bundles with constant pitch may be equipped at both ends thereof according to the invention with auxiliary distributors and collectors between the core tube and the tubular shell.

When the tube bundles of the heat exchanger consist of tubes of low rigidity, for example tubes of plastics materials or small pliant metallic tubes, the tube bundles of flexible tubes are supported in accordance with the invention by staggered supporting brackets, such as are shown in FIGS. 3 to 7.

Figure 3:
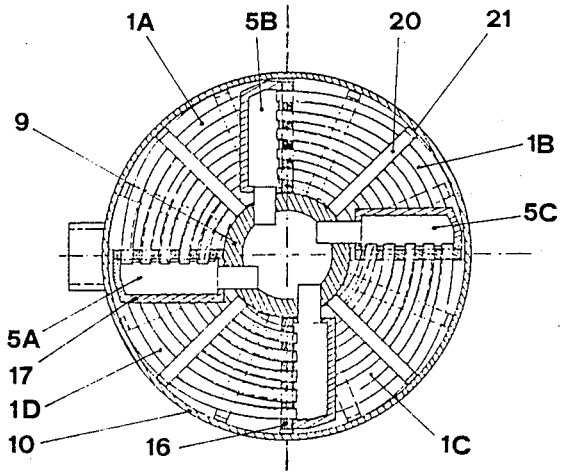
FIG. 3 a cross-section of a further embodiment with four tube bundles and supporting brackets.

The heat exchanger shown in cross-section in FIG. 3 corresponds essentially to the described arrangement according to FIGS. 1 and 2, while similar parts are designated by the same reference numerals in all figures.

However, the embodiment according to FIG. 3 has four helical tube bundles 1A to 1D each with four corresponding auxiliary distributors and collectors, which in each case correspond to the connecting compartment according to FIG. 2.

The four helical tube bundles 1A to 1D with the four auxiliary distributors or connecting compartments 5A to 5D as well as brackets 20 and straps 21 are shown in FIG. 3.

In the embodiments according to FIGS. 3 to 8, the heat exchanger is equipped with a plurality of supporting brackets 20 which each support one of the helical tube bundles, are fixed to the core tube 9 and are distributed in the helical planes corresponding to the tube bundles, while the helical tubes freely rest against these brackets and are supported thereon.

It may further be seen from FIGS. 3 and 6 that these brackets extend from the core tube 9 radially outwards to the inner side of the tubular shell 10, while they are secured at their free ends by straps 21.

The supporting brackets 20 according to the invention are distributed in different radial planes, so that they are in each case aligned in corresponding rows parallel to the common longitudinal axis, as is particularly apparent from FIG. 6, while the axial distance between the brackets in each row corresponds to the spacing between the adjacent windings of the tube bundles and thereby determines the axial height of each helical flow channel.

FIG. 4 shows, to simplify the drawing, only two helical tube sections and two brackets 20 fixed to the core tube 9, which are arranged in the corresponding helical plane and are slightly inclined outwardly in opposite axial directions with respect to the perpendicular to the longitudinal axis. The helical tubes here freely rest alternately on opposite sides of the successively arranged supporting brackets 20 and are thereby slightly bent alternately in opposite axial directions.

FIG. 5 shows the developed projection of a helical tube which is supported in this manner and alternately slightly bent by the brackets 20. The helical tubes are braced by such a wavelike arrangement on the brackets 20 and are thereby kept in their position on each bracket.

FIGS. 6 and 7 show more particularly an arrangement of the straps 21 for securing the support brackets 20 at their free ends in the same radial plane and with the required spacing which determines the axial height of the helical flow channels. These straps 21 each consist of a longitudinal band with a smooth outer side, have about the same width as the brackets 20 and are folded at regular intervals corresponding to the required axial height of the helical flow channels.

These folded straps 21 thus present a series of parallel, inwardly directed bearing surfaces 22 for supporting the corresponding brackets 20 which are each provided at their free end with a slot 23. The position of the brackets 20 is here set by snap fastening means which consist of the slot 23 at the end of each of the brackets 20 and a corresponding barb 24 which projects from the bearing surface 22 and is adapted to hook into the slot 23.

FIG. 7 essentially shows the form of the strap 21 and its cooperation with a bracket 20. The straps 21 shown here may consist for example of metallic strips of 0.2 mm thickness, while they present a high rigidity due to their folded shape.

As may be seen from FIGS. 6 and 7, the helical tubes are arranged contiguously on the support arms 20, while the outermost coils are each set in their position at the end of the brackets 20 due to the barbs 24 of the straps 21 being adapted to fit into the corresponding slots 23 at the ends of the brackets 20.

The straps 21 here ensure the outer radius of the tube bundles as well as adapting them exactly to the inner diameter of the tubular shell 10, whereby to ensure the required tightness of the helical flow channels as well as their constant axial height at the periphery of the tube bundles.

These lateral straps 21 further serve to take up any forces which may be possibly exerted on the outermost tube coils due to axial movement of the tubular shell 10 relative to the tube bundles, particularly when the tubular shell is removed for cleaning the tube bundles.

The arrangement of the straps 20 shown in FIG. 6 and 7 does not substantially reduce the flow cross-section of the helical flow channels and the outer surface of the helical tube bundles.

FIG. 8 shows an embodiment with helical tube bundles 1A, 1B, 1C which lie on both sides on double-flanged brackets 120 with cross-webs 121. In this case each strap according to FIG. 8 consists of a flat longitudinal band 122 and is connected to the outermost web of the bracket 120 by suitable fastening means, for example inwardly projecting locking pins which latch into corresponding openings in the outermost web of the double-flanged bracket 120 in order to function as snap-fastening means. The lateral straps may also have any other suitable form for cooperation with the brackets in accordance with the invention. The embodiment according to FIG. 8 is particularly suitable for applications which require an embodiment of the heat exchanger made of plastics in order to ensure an adequate resistance against corrosive media.

I claim:

1. In a counter-flow heat exchanger of the type comprising:

at least one helical tube bundle arranged in an annular chamber between a core tube and a coaxial tubular shell and connected to a primary inlet and a primary outlet for flow of a primary fluid through said helical tube bundle;

a plurality of contiguous helical tubes associated with said bundle and connected in parallel to said primary inlet and said primary outlet, said helical tubes being coiled in a corresponding helical plane with constant pitch around a common longitudinal axis and being closely arrayed without interruption between said core tube and said tubular shell so as to define therewith at least one closed helical channel connected to a secondary inlet and a secondary outlet so as to thereby provide for flow of a secondary fluid through said closed helical channel in countercurrent with the primary fluid flowing through said helical tube bundle, the improvements comprising;

said helical tube bundle being equipped with two auxiliary connecting compartments lying within said annular chamber and each consisting of a perforated auxiliary connecting plate arranged perpendicular to said corresponding helical plane and a removable cover sealingly mounted on said auxiliary connecting plate and connected to said primary inlet or outlet; and said auxiliary connecting plate comprising staggered perforations arranged parallel to said corresponding helical plane and offset with respect thereto so that the ends of said contiguous helical tubes are accommodated in corresponding perforations and sealingly secured in said connecting plate without undergoing significant bending with respect to said corresponding helical plane.

2. The heat exchanger of claim 1, wherein said helical tubes are flexible and rest freely against a plurality of brackets which are secured to said core tube and are arranged in said helical plane around said core tube in such manner that said helical tubes are supported against one another in an immovable position.

3. The heat exchanger of claim 2, wherein said helical tubes are flexible and rest freely against a plurality of brackets which are secured to said core tube and are arranged in said helical plane around said core tube in such manner that said helical tubes are supported against one another in an immovable position.

4. The heat exchanger of claim 2, wherein said flexible helical tubes are alternately bent and supported in opposite axial directions in said helical plane by said brackets.

5. The heat exchanger of claim 2, wherein said brackets are profiled to provide stiffening.

6. The heat exchanger of claim 2, wherein said brackets are inclined with respect to said common longitudinal axis.

7. The heat exchanger of claim 6, wherein said brackets are alternately inclined in opposite axial directions.

8. The heat exchanger of claim 2, wherein said brackets are positioned in different radial planes and are interconnected at their free ends with straps in each radial plane.

* * * * *